US011783765B1

(12) United States Patent
Chang et al.

(10) Patent No.: US 11,783,765 B1
(45) Date of Patent: Oct. 10, 2023

(54) HIGH EFFICIENCY LIGHT EMITTING DIODE DRIVER CIRCUIT AND CONTROL METHOD THEREOF

(71) Applicant: Richtek Technology Corporation, Hsinchu (TW)

(72) Inventors: Chia-Jung Chang, Hsinchu (TW); Shao-Ming Chang, Hsinchu (TW); Hsiang-Feng Yu, Hsinchu (TW); Tso-Yu Wu, Hsinchu (TW); Yu-Pin Tseng, Hsinchu (TW)

( * ) Notice: Subject to any disclaimer, the term of this patent is extended or adjusted under 35 U.S.C. 154(b) by 0 days.

(21) Appl. No.: 18/177,712

(22) Filed: Mar. 2, 2023

Related U.S. Application Data

(60) Provisional application No. 63/339,921, filed on May 9, 2022.

(30) Foreign Application Priority Data

Sep. 28, 2022 (TW) ..... 111136864

(51) Int. Cl.
*G09G 3/32* (2016.01)

(52) U.S. Cl.
CPC ..... *G09G 3/32* (2013.01); *G09G 2300/0842* (2013.01); *G09G 2310/0248* (2013.01); *G09G 2310/0267* (2013.01); *G09G 2310/0275* (2013.01); *G09G 2310/0278* (2013.01); *G09G 2320/0257* (2013.01); *G09G 2330/021* (2013.01)

(58) Field of Classification Search
CPC ..... G09G 3/32; G09G 2300/0842; G09G 2310/0248; G09G 2310/0267; G09G 2310/0275; G09G 2310/0278; G09G 2320/0257; G09G 2330/021
See application file for complete search history.

(56) References Cited

U.S. PATENT DOCUMENTS

2005/0264499 A1* 12/2005 Kim ..... G09G 3/3216 345/76
2007/0057880 A1* 3/2007 Nam ..... G09G 3/3216 345/77
2021/0272509 A1* 9/2021 Ko ..... G09G 3/2014
2021/0375200 A1* 12/2021 Lin ..... G09G 3/32
2022/0223099 A1* 7/2022 Chao ..... G09G 3/32

* cited by examiner

*Primary Examiner* — Andrew Sasinowski
(74) *Attorney, Agent, or Firm* — Huan Yi Lin

(57) ABSTRACT

A light emitting diode (LED) driver circuit is configured to drive plural LEDs which are respectively coupled to m scan-lines and n data-lines, wherein m and n are both integers greater than or equal to one. During a driving stage, each of the LEDs is controlled to emit light according to the electrical characteristics on the corresponding scan-line and on the corresponding data-line where the LED is coupled to. The LED driver circuit includes: a power saving control circuit which includes a storage capacitor; a pre-discharging circuit configured to pre-discharge the charges on the m scan-lines to the storage capacitor during a pre-discharging stage; and a pre-charging circuit configured to pre-charge the n data-lines by the charges stored in the storage capacitor during a pre-charging stage.

16 Claims, 7 Drawing Sheets

HIGH EFFICIENCY LIGHT EMITTING DIODE DRIVER CIRCUIT AND CONTROL METHOD THEREOF

CROSS REFERENCE

The present invention claims priority to U.S. 63/339,921 filed on May 9, 2022 and claims priority to TW 111136864 filed on Sep. 28, 2022.

BACKGROUND OF THE INVENTION

Field of Invention

The present invention relates to a light emitting diode (LED) driver circuit and a control method thereof; particularly, it relates to a high efficiency LED driver circuit and a control method of such LED driver circuit which are capable of reducing power consumption.

Description of Related Art

U.S. Pat. No. 8,659,514B2, U.S. Pat. No. 9,552,794B2, U.S. Pat. No. 9,818,338B2 and U.S. Pat. No. 10,692,422B2 are pertinent to the present invention.

Please refer to FIG. 1, which shows a schematic diagram of a conventional LED driver circuit. The conventional LED driver circuit 1000 comprises: plural LEDs, a pre-charging circuit 110, a pre-discharging circuit 120, a scan-line control circuit 130 and a data-line control circuit 140. The plural LEDs are arranged as an m by n matrix wherein m is the number of rows and n is the number of columns, wherein the plural LEDs are respectively coupled to corresponding m scan-lines and corresponding n data-lines. During a driving stage, the scan-line control circuit 140 sequentially provides power to the m scan-lines, whereas, the data-line control circuit 130 provides respective driving currents to the n data-lines, so as to control the corresponding LEDs to emit light with corresponding brightness. Because there are parasitic capacitances existing in the scan-lines and the data-lines, residual charges will undesirably result in ghost images. In order to remove the ghost images, the conventional LED driver circuit 1000 pre-charges the data-lines and scan-lines by the pre-charging circuit 110 during a pre-charging stage and pre-discharges the data-lines and scan-lines by the pre-discharging circuit 120 during a pre-discharging stage, so as to eliminate ghost images.

In the aforementioned prior art, the pre-charging circuit 110 includes n amplifiers, wherein the n amplifiers correspond to the n data-lines. One of the n amplifiers is taken herein as an example to illustrate how the prior art eliminates ghost images. As shown in FIG. 1, during the pre-charging stage, the amplifier 11 pre-charges the corresponding data-line by a power supply Vs (i.e., a positive power supply) via a pre-charging path Pc01, so as to regulate a voltage of that corresponding data-line to a reference voltage Vrc. On the other hand, as shown in FIG. 1, the pre-discharging circuit 120 includes an amplifier 12, wherein during the pre-discharging stage, the amplifier 12 pre-discharges the m scan-lines to a ground potential (i.e., a negative power supply of the amplifier 12) via a pre-discharging path Pdc01, so as to regulate the voltages of the m scan-lines to a reference voltage Vrdc.

Although the aforementioned prior art can prevent ghost images from occurring, the prior art shown in FIG. 1 has the following drawbacks: first, the prior art needs to conduct a pre-charging operation by extra power. Second, the residual charges are discharged to the ground potential during the pre-discharging stage. Both of the above features will result in unwanted extra power consumption.

In view of the above, to overcome the drawbacks in the prior art, the present invention proposes an LED driver circuit and a control method thereof, which are capable of storing the charges generated during a pre-discharging stage and providing these charges during the next pre-discharging stage, to save power and enhance efficiency.

SUMMARY OF THE INVENTION

From one perspective, the present invention provides a light emitting diode (LED) driver circuit, which is configured to operably drive a plurality of LEDs, wherein the plurality of LEDs are respectively coupled to corresponding m scan-lines and corresponding n data-lines, wherein m and n are both integers greater than or equal to one, wherein during a driving stage, each of the LEDs is controlled to emit light according to electrical characteristics on the corresponding scan-line and on the corresponding data-line where the LED is coupled to; the LED driver circuit comprising: a power saving control circuit, which includes a storage capacitor; a pre-discharging circuit, which is configured to operably pre-discharge charges on the m scan-lines to the storage capacitor during a pre-discharging stage; and a pre-charging circuit, which is configured to operably pre-charge the n data-lines by the charges stored in the storage capacitor during a pre-charging stage.

In one embodiment, the LED driver circuit further comprises: a scan-line control circuit, which is configured to operably and sequentially provide power supply to the m scan-lines during the driving stage; and a data-line control circuit, which is configured to operably provide respective driving currents to the n data-lines according to corresponding data during the driving stage, so as to control the corresponding LEDs to emit corresponding brightness.

In one embodiment, the pre-discharging circuit includes: a discharging amplifier, which is configured to operably pre-discharge voltages on the m scan-lines and regulate the voltages on the m scan-lines to a pre-discharging voltage during the pre-discharging stage; the pre-charging circuit includes: a charging amplifier, which is configured to operably pre-charge voltages on the n data-lines and regulate the voltages on the n data-lines to a pre-charging voltage during the pre-charging stage; wherein a negative power supply end of the discharging amplifier is coupled to the storage capacitor, so that a voltage of the storage capacitor functions as a negative power supply of the discharging amplifier, to thereby pre-discharge the charges on the m scan-lines to the storage capacitor; wherein a positive power supply end of the charging amplifier is coupled to the storage capacitor, so that the voltage of the storage capacitor functions as a positive power supply of the charging amplifier, to thereby pre-charge the n data-lines by the charges stored in the storage capacitor.

In one embodiment, the power saving control circuit further includes: a first clamping circuit and a second clamping circuit, wherein the first clamping circuit is configured to operably clamp the voltage of the storage capacitor, so that the voltage of the storage capacitor is not lower than a first clamp voltage, and wherein the second clamping circuit is configured to operably clamp the voltage of the storage capacitor, so that the voltage of the storage capacitor is not higher than a second clamp voltage, wherein the first clamp voltage is lower than the second clamp voltage.

In one embodiment, the first clamping circuit includes: a first diode, which is forwardly coupled between a first reference voltage and the storage capacitor, wherein the first clamp voltage is a difference between the first reference voltage and a forward conduction voltage of the first diode; wherein the second clamping circuit includes: a second diode, which is forwardly coupled between the storage capacitor and the first reference voltage, wherein the second clamp voltage is a sum of the first reference voltage plus a forward conduction voltage of the second diode.

In one embodiment, the first clamping circuit includes: a first transistor, which is coupled to the storage capacitor; and a first amplifier, which is configured to operably control the first transistor according to a difference between the first clamp voltage and the voltage of the storage capacitor, so as to clamp the voltage of the storage capacitor, so that the voltage of the storage capacitor is not lower than the first clamp voltage; wherein the second clamping circuit includes: a second transistor, which is coupled to the storage capacitor; and a second amplifier, which is configured to operably control the second transistor according to a difference between the second clamp voltage and the voltage of the storage capacitor, so as to clamp the voltage of the storage capacitor, so that the voltage of the storage capacitor is not higher than the second clamp voltage.

In one embodiment, the pre-discharging circuit further includes: a third clamping circuit, which is configured to operably clamp an amplifier power supply voltage between a positive power supply end of the discharging amplifier and the negative power supply end of the discharging amplifier, so that the amplifier power supply voltage is not higher than a third clamp voltage.

In one embodiment, the third clamping circuit includes: a third transistor, which is coupled between the storage capacitor and the negative power supply end of the discharging amplifier; and a voltage offset circuit, which is coupled between a control end of the third transistor and the positive power supply end of the discharging amplifier, wherein the voltage offset circuit is configured to operably control the third transistor to clamp the amplifier power supply voltage, so that the amplifier power supply voltage is not higher than the third clamp voltage; wherein the third clamp voltage is correlated with an offset voltage of the voltage offset circuit and a conduction threshold of the third transistor.

In one embodiment, a maximum rating voltage of the third transistor is higher than a maximum rating voltage of the discharging amplifier, and/or the maximum rating voltage of the third transistor is higher than a maximum rating voltage of the power saving control circuit.

In one embodiment, the power saving control circuit further includes: a current balance circuit, which is configured to operably control a bias current required by the pre-charging circuit according to a difference between the voltage of the storage capacitor and a second reference voltage, so as to adjust a quiescent state current consumption of the pre-charging circuit, so that in a steady state, the charges pre-discharged from the m scan-lines and the charges pre-charged to the n data-lines are controlled to be balanced to each other.

In one embodiment, the current balance circuit includes: a comparison circuit, which is configured to operably compare the voltage of the storage capacitor with the second reference voltage, to generate a comparison result; an integration circuit, which is configured to operably control a pull-up current source and a pull-down current source according to the comparison result, to generate an integration voltage at an integration capacitor; and a bias current generation circuit, which is configured to operably generate the bias current according to the integration voltage, wherein the bias current is correlated with the integration voltage.

From another perspective, the present invention provides a control method configured to operably control a light emitting diode (LED) driver circuit, wherein the LED driver circuit includes a plurality of LEDs, wherein the plurality of LEDs are respectively coupled to corresponding m scan-lines and corresponding n data-lines, wherein m and n are both integers greater than or equal to one; the control method comprising: during a driving stage, controlling each of the LEDs to emit light according to electrical characteristics on the corresponding scan-line and on the corresponding data-line where the LED is coupled to; during a pre-discharging stage, pre-discharging charges on the m scan-lines to a storage capacitor; during a pre-charging stage, pre-charging the n data-lines by the charges stored in the storage capacitor.

In one embodiment, the control method further comprises: during the driving stage, sequentially providing power supply to the m scan-lines; and during the driving stage, providing driving currents to the n data-lines according to corresponding data, so as to control the corresponding LEDs to emit corresponding brightness.

In one embodiment, the control method further comprises: clamping a voltage of the storage capacitor, so that the voltage of the storage capacitor is not lower than a first clamp voltage; clamping the voltage of the storage capacitor, so that the voltage of the storage capacitor is not higher than a second clamp voltage; wherein the first clamp voltage is lower than the second clamp voltage.

In one embodiment, the control method further comprises: controlling a bias current required by a pre-charging circuit according to a difference between the voltage of the storage capacitor and a reference voltage, so as to adjust a quiescent state current consumption of the pre-charging circuit, so that in a steady state, the charges pre-discharged from the m scan-lines and the charges pre-charged to the n data-lines are controlled to be balanced to each other; wherein the pre-charging circuit is configured to operably pre-charge the n data-lines by the charges stored in the storage capacitor during the pre-charging stage.

In one embodiment, the step for controlling the bias current includes: comparing the voltage of the storage capacitor with the reference voltage, to generate a comparison result; controlling a pull-up current source and a pull-down current source according to the comparison result, to generate an integration voltage at an integration capacitor; and generating the bias current according to the integration voltage, wherein the bias current is correlated with the integration voltage.

The objectives, technical details, features, and effects of the present invention will be better understood with regard to the detailed description of the embodiments below, with reference to the attached drawings.

DESCRIPTION OF THE PREFERRED EMBODIMENTS

Figure 1:
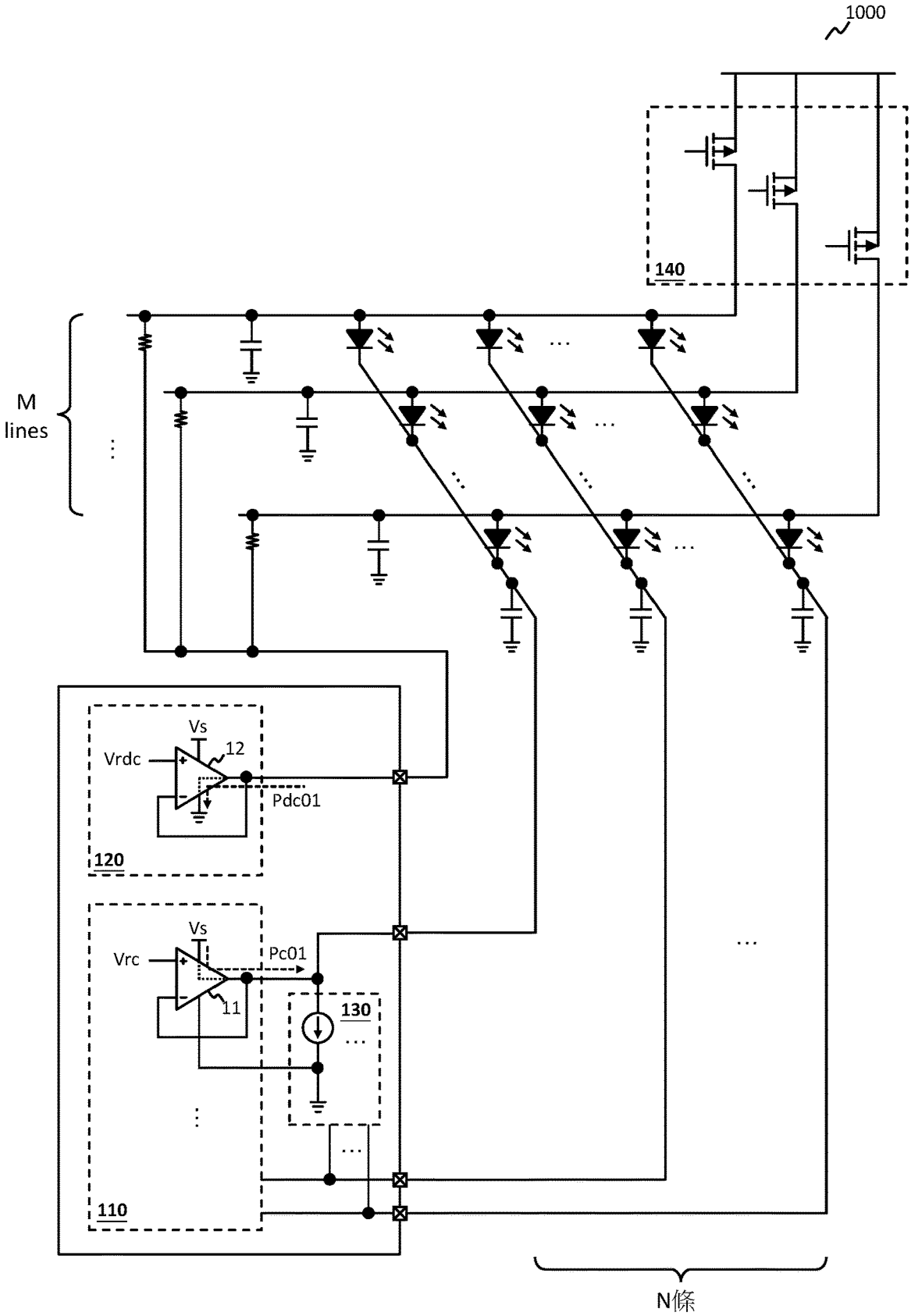
Fig. 1 (Prior Art)
FIG. 1 shows a schematic diagram of a conventional light emitting diode (LED) driver circuit.
Figure 2A:
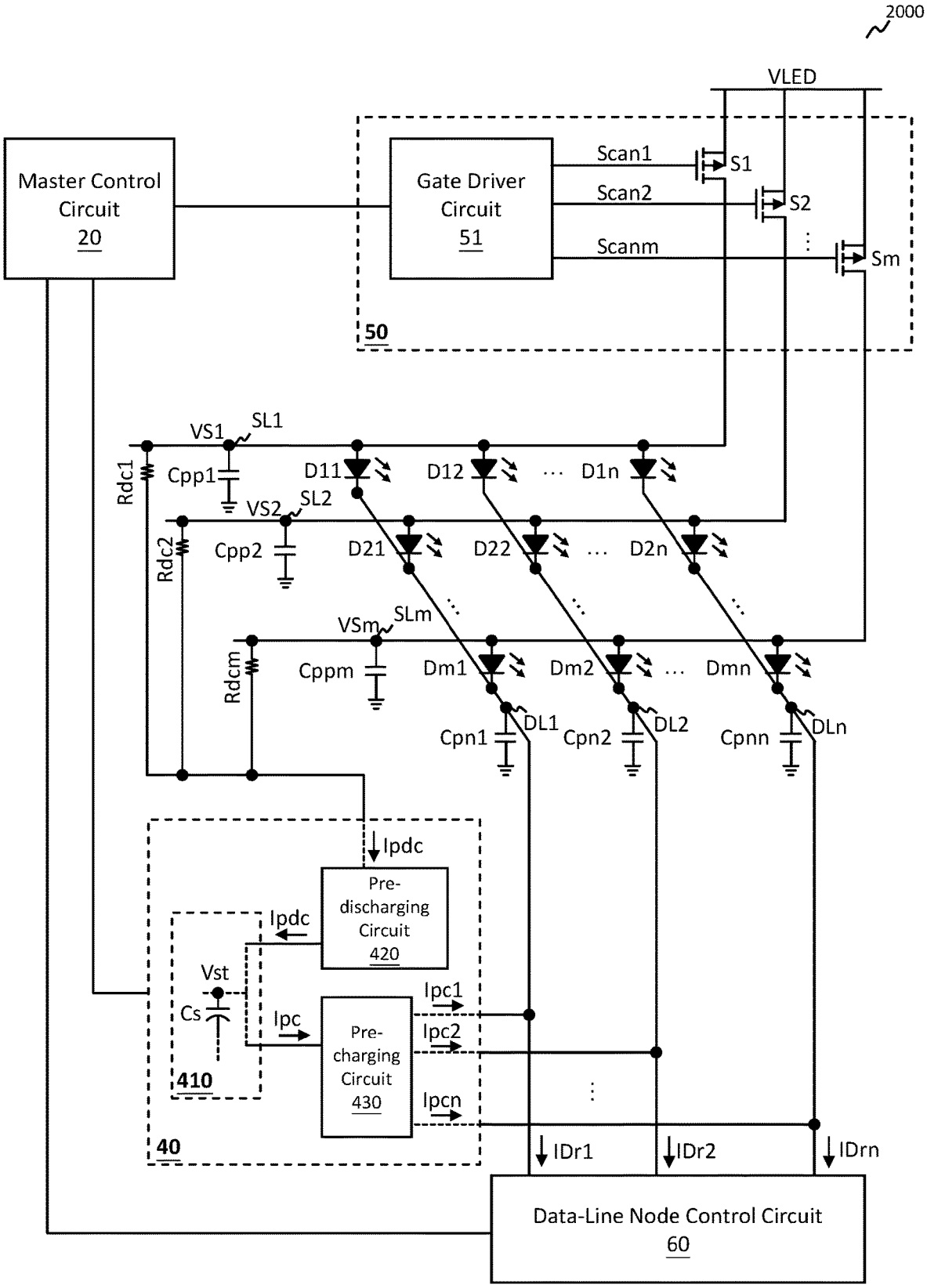
FIG. 2A shows a schematic block diagram of an LED driver circuit according to an embodiment of the present invention.

The drawings as referred to throughout the description of the present invention are for illustration only, to show the interrelations between the circuits and the signal waveforms, but not drawn according to actual scale of circuit sizes and signal amplitudes and frequencies. For better understanding the essence of the present invention, practical implementation details will be described in the embodiments below. It should be understood that such details are not for limiting the broadest scope of the present invention Please refer to FIG. 2A, which shows a schematic block diagram of an LED driver circuit according to an embodiment of the present invention. The LED driver circuit 2000 of FIG. 2A comprises: a pre-power supply circuit 40, a scan-line control circuit 50 and a data-line control circuit 60. In one embodiment, a master control circuit 20 controls the LED driver circuit 2000 to drive plural LEDs. The plural LEDs are arranged as an m by n matrix wherein m is the number of rows and n is the number of columns, wherein m and n are both integers greater than or equal to one. In the embodiment of FIG. 2A, the plural LEDs are arranged as a diode matrix and the LEDs are given reference numbers as diode D11 ($1^{st}$ row, $1^{st}$ column) to diode Dmn ($m^{th}$ row, $n^{th}$ column). In one embodiment, the plural LEDs are respectively coupled to corresponding m scan-lines and corresponding n data-lines. During a driving stage, each of the LEDs is controlled to emit light according to the electrical characteristics on the corresponding scan-line and data-line where the LED is coupled to. For example, the diode D11 is controlled to emit light according to the electrical characteristics on the corresponding scan-line SL1 and data-line DL1 where the diode D11 is coupled to. It should be understood that the 2-dimensional arrangement as illustrated above is only an illustrative example, but not for limiting the broadest scope of the present invention; the plural LEDs can be arranged otherwise.

In one embodiment, as shown in FIG. 2A, the scan-line control circuit 50 includes: a gate driver circuit 51 and m switches (i.e., switch S1 to switch Sm). In this embodiment, the switch S1 to the switch Sm are implemented as P-type metal oxide semiconductor (MOS) devices. In one embodiment, during a driving stage, the gate driver circuit 51 is configured to operably generate scan signals Scan1 to Scanm according to the control by the master control circuit 20. The scan signals Scan1 to Scanm serves to sequentially turn ON the switches S1 to Sm, so as to sequentially provide a power supply VLED to the m scan-lines during the driving stage. In one embodiment, during the driving stage, the data-line control circuit 60 is configured to operably provide respective driving currents to the n data-lines according to corresponding data provided by the master control circuit 20 and stored in a memory circuit 30, so as to control the corresponding LEDs to emit light with corresponding brightness. More specifically, in this embodiment, when the power supply VLED is provide to the scan-line corresponding to an LED and the data-line corresponding to the LED is driven by a driving current, the LED is forward conductive to emit light with the corresponding brightness according to the intensity of the driving current.

Please still refer to FIG. 2A. Because there are parasitic capacitances in the m scan-lines (expressed by parasitic capacitors Cpp1 to Cppm in FIG. 2A) and also parasitic capacitances in the n data-lines (expressed by parasitic capacitors Cpn1 to Cpnn in FIG. 2A), when the scan-line control circuit 50 and the data-line control circuit 60 control corresponding LEDs to emit light, there is a likelihood that residual charges on the parasitic capacitors will cause non-corresponding LEDs to become forward conductive for a short time and to emit light, which will undesirably result in ghost images. In one embodiment, the pre-power supply circuit 40 includes: a power saving control circuit 410, a pre-discharging circuit 420 and a pre-charging circuit 430. In one embodiment, the power saving control circuit 410 includes a storage capacitor Cs. The pre-discharging circuit 420 is configured to operably pre-discharge the m scan-lines and store charges thereon to the storage capacitor Cs via a pre-discharging current Ipdc during a pre-discharging stage. The pre-charging circuit 430 is configured to operably pre-charge the n data-lines by the charges stored in the storage capacitor Cs via a pre-charging current Ipc during a pre-charging stage, and to thereby eliminate ghost images. It is noteworthy that, in the present invention, the pre-charging operation is achieved by providing charges stored in the storage capacitor Cs during the pre-discharging stage, which can save power and enhance efficiency.

Figure 2B:
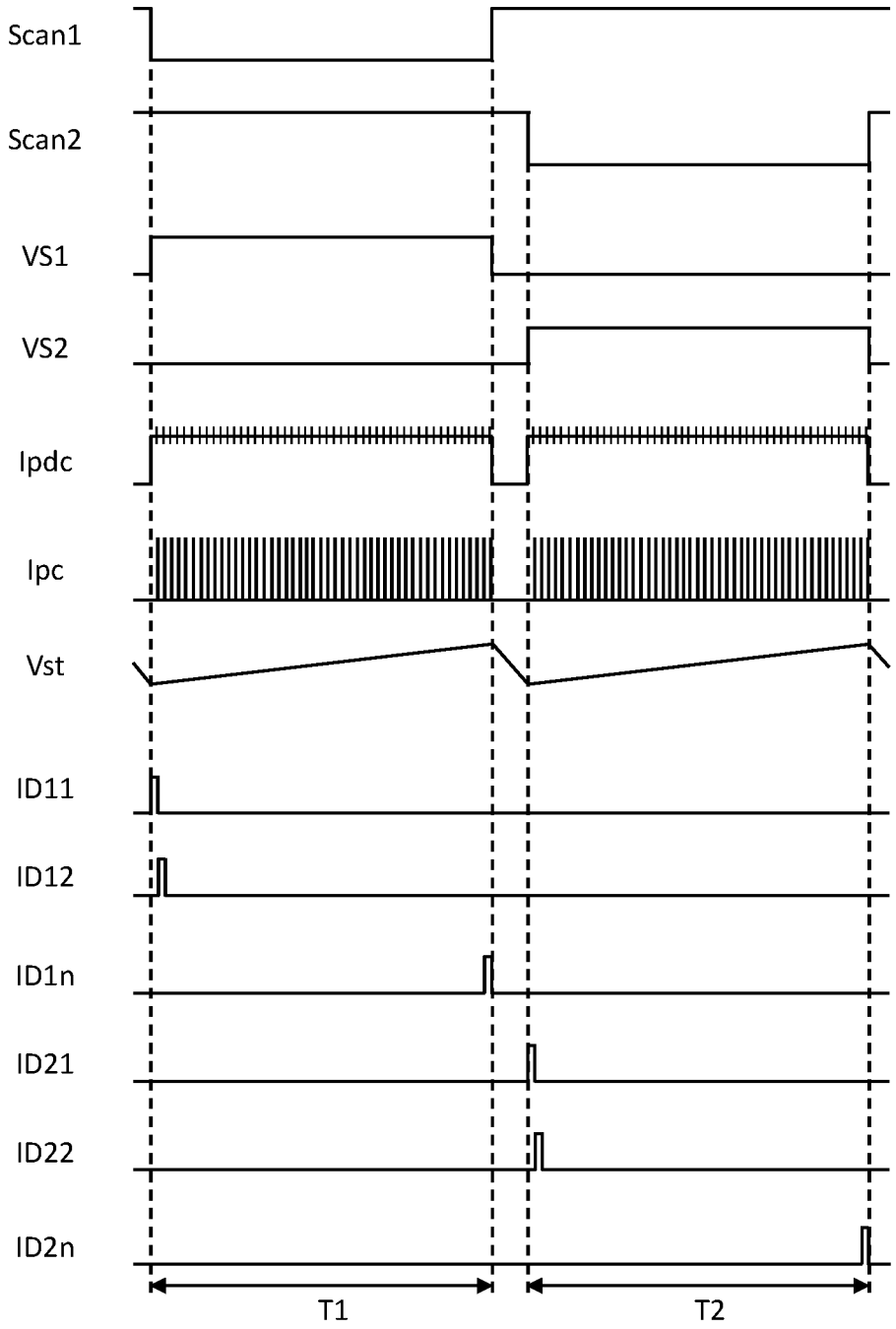
FIG. 2B illustrates a signal waveform diagram depicting the operation of the LED driver circuit of FIG. 2A.

Please refer to FIG. 2A and FIG. 2B. FIG. 2B illustrates a signal waveform diagram depicting the operation of an LED driver circuit of FIG. 2A. For simplicity, FIG. 2B only illustrates the operation waveform V1 of a first row scan-line SL1 and the operation waveform V2 of a second row scan-line SL2. The operation waveforms of rest scan-lines can be derived by analogy. As shown by first to fourth operation waveforms in FIG. 2B, the switch S1 is ON during the period T1 according to the control of the scan signal Scan1, so that the voltage VS1 of the scan-line SL1 is elevated to high level (e.g., VLED) during the period T1. The switch S2 is ON during the period T2 according to the control of the scan signal Scan2, so that the voltage VS2 of the scan-line SL2 is elevated to high level (e.g., VLED) during the period T2. During the period T1, because the switch S1 corresponding to the first row scan-line SL1 is ON and the voltage VS1 is at high level, the scan-line control circuit 60 sequentially provides the driving currents IDr1 to IDrm during the period T1, to turn ON the diodes D11 to D1n sequentially, so that the diodes D11 to D1n sequentially emit light with corresponding brightness. During the period T1, the pre-discharging current Ipdc is at high level, so as to pre-discharge the charges on the m scan-lines to store these charges in the storage capacitor Cs via the discharging resistors Rdc1 to Rdcm (as shown in FIG. 2A), respectively. More specifically, during the period T1, when one (i.e., scan-line SL1) of the m scan-lines is at high level VLED because the corresponding switch (i.e., switch S1) is ON, the rest m-1 scan-lines (i.e., scan-lines SL2 to SLm) have their respective voltages determined by their respective residual charges. The pre-discharging circuit 420 is configured to operably pre-discharge these charges on the scan-lines SL2 to SLm via the pre-discharging current Ipdc and store the these charges in the storage capacitor Cs. In one embodiment, the pre-discharging circuit 420 is configured to operably pre-discharge the scan-lines SL2 to SLm to low level (e.g., the voltage VS2 during the period T1 in FIG. 2B). The details of the pre-discharging circuit 420 will be explained later.

On the other hand, during the period T1, the scan-line control circuit 60 sequentially provides the driving currents IDr1 to IDrm to the data-lines DL1 to DLn, respectively, to turn ON the diodes D11 to D1n sequentially, so that the diodes D11 to D1n can sequentially emit light with corresponding brightness. More specifically, as shown in FIG. 2B, the currents ID11 to ID1n of the diodes D11 to D1n sequentially rise to high level of the corresponding driving currents IDr1 to IDrm. When one (e.g., data-line DL1) of the n data-lines is at high level VLED because the corresponding driving current IDr1 is at high level, the voltage of the data-line DL1 is equal to VLED-Vf, wherein Vf is the forward conduction voltage of the diode D11. Besides, the rest n-1 data-lines (i.e., data-line DL2 to data-line DLn) have their respective voltages determined by their respective residual charges. In this case, the pre-charging circuit 430 pre-charges the data-lines DL2 DLn via pre-charging currents Ipc2 to Ipcn. In one embodiment, the aforementioned pre-charging current Ipc is a sum of the pre-charging currents which serve to pre-charge the n-1 data-lines (i.e., the sum of the pre-charging currents Ipc2 to Ipcn), wherein the charges for pre-charging the n-1 data-lines are provide by the storage capacitor Cs. In one embodiment, the pre-charging circuit 430 is configured to operably pre-charge the n-1 data-lines (i.e., the data-lines DL2 to DLn) to high level. The operation details of the pre-charging circuit 430 will be explained later.

Referring to FIG. 2B, each pulse in the waveform of the pre-charging current Ipc corresponds to one of the pre-charging currents Ipc1 to Ipcn after the diode currents ID11 to ID1n switch to low level (e.g., zero). Besides, in one embodiment, during the period T1, the voltage Vst of the storage capacitor Cs slowly increases. In one embodiment, when the pre-discharging current Ipdc is equal to the pre-charging current Ipc, the average of the voltage Vst of the storage capacitor Cs can be maintained in a specific range or maintained at a constant.

During the period T2, the switch S2 corresponding to the second row scan-line SL2 is ON, and the signal waveforms during the period T2 are similar to the signal waveforms during the period T1; the details thereof are not redundantly explained here.

It is noteworthy that, for a scan-line (e.g., scan-line SL1), the aforementioned pre-discharging stage corresponds to a time period other than the driven period (e.g., the period T1) wherein the scan-line is driven, and for a data-line (e.g., data-line DL1), the aforementioned pre-discharging stage corresponds to a time period other than the driven period (e.g., when ID11 is at high level in FIG. 2B) wherein the data-line DL1 is driven.

Figure 3:
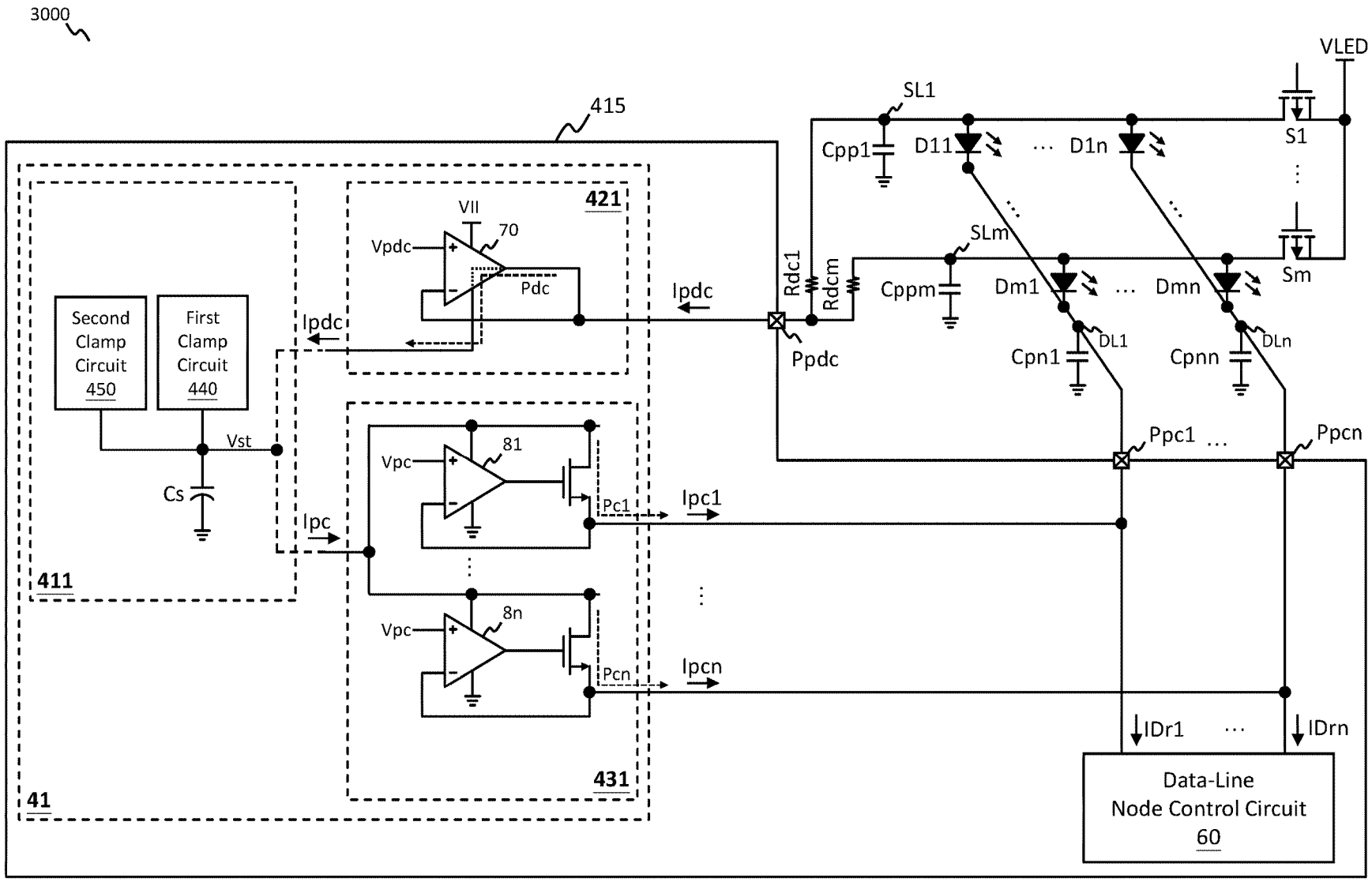
FIG. 3 shows a schematic diagram of an LED driver circuit according to an embodiment of the present invention.

Please refer to FIG. 3, which shows a schematic diagram of an LED driver circuit according to an embodiment of the present invention. The LED driver circuit 3000 of this embodiment shown in FIG. 3 is similar to the LED driver circuit 2000 of the embodiment shown in FIG. 2. The pre-power supply circuit 41 of FIG. 3 includes: a power saving control circuit 411, a pre-discharging circuit 421 and a pre-charging circuit 431. In the embodiment of FIG. 3, the pre-power supply circuit 41 and a data-line control circuit 60 are integrated into an integrated circuit (IC) 415. In one embodiment, the pre-discharging circuit 421 is coupled to scan-lines SL1 to SLm (via discharging resistors Rdc1 to Rdcm) via a pin Ppdc of the IC 415. The pre-charging circuit 431 is coupled to data-lines DL1 to DLn via pins Ppc1 to Ppcn of the IC 415, respectively. For simplicity, FIG. 3 only illustrates the first row scan-line SL1, the $m^{th}$ row scan-line SLm, the first column data-line DL1 and the $n^{th}$ column data-line DLn. That is, the second row scan-line SL2 to the $(m-1)^{th}$ row scan-line SL(m−1) and the second column data-line DL2 to the (n−1)th column data-line DL(n−1) are omitted from FIG. 3. The following description will be based upon what are illustrated in FIG. 3.

In one embodiment, the pre-discharging circuit 421 includes: a discharging amplifier 70, which is configured to operably pre-discharge voltages on the m scan-lines and regulate the voltages on the m scan-lines to a pre-discharging voltage via a pre-discharging current Ipdc flowing through a pre-discharging path Pdc during the pre-discharging stage. In one embodiment, the discharging amplifier 70 is implemented as a unit gain amplification circuit shown in FIG. 3, wherein such unit gain amplification circuit regulates the voltages on the m scan-lines to the pre-discharging voltage according to a reference voltage Vpdc. In one embodiment, the pre-charging circuit 431 includes: charging amplifiers 81 to 8n, wherein the pre-charging circuit 431 is configured to operably pre-charge voltages on the n data-lines and regulate the voltages on the n data-lines to a pre-charging voltage during the pre-charging stage. To be more specific, the charging amplifiers 81 to 8n are configured to operably pre-charge voltages on the n data-lines and regulate the voltages on the n data-lines to the pre-charging voltage via a pre-charging current Ipc flowing through pre-charging paths Pc1 to Pcn during the pre-charging stage. In one embodiment, each of the charging amplifiers 81 to 8n is implemented as a unit gain amplification circuit shown in FIG. 3, wherein such unit gain amplification circuit regulates the voltages on the n data-lines to the pre-charging voltage according to a reference voltage Vpc.

In this embodiment, a positive power supply end of the discharging amplifier 70 is coupled to an internal power supply VII, whereas, a negative power supply end of the discharging amplifier 70 is coupled to the storage capacitor Cs, so that a voltage Vst of the storage capacitor Cs functions as a negative power supply of the discharging amplifier 70, and when the discharging amplifier 70 pre-discharges the m scan-lines, the charges on the m scan-lines are stored in the storage capacitor Cs. On the other hand, in this embodiment, a negative power supply end of each of the charging amplifiers 81 to 8n is coupled to a ground potential, whereas, a positive power supply end of each of the charging amplifiers 81 to 8n is coupled to the storage capacitor Cs, so that the voltage Vst of the storage capacitor Cs functions as a positive power supply of each of the charging amplifiers 81 to 8n, and to thereby pre-charge the corresponding n data-lines by the charges stored in the storage capacitor Cs.

It is worthwhile noting that, in one embodiment, the aforementioned pre-discharging current Ipdc also provides an operation current required by the pre-discharging circuit 421, which is for example a bias current required by the discharging amplifier 70. On the other hand, in one embodiment, the aforementioned pre-charging current Ipc also provides an operation current required by the pre-charging circuit 431, which is for example a bias current required by each of the charging amplifiers 81 to 8n.

As shown in FIG. 3, in one embodiment, the power saving control circuit 411 further includes: a clamping circuit 440 and a clamping circuit 450. In one embodiment, the clamping circuit 440 is configured to operably clamp the voltage Vst of the storage capacitor Cs, so that the voltage Vst of the storage capacitor Cs is not lower than a first clamp voltage, whereas, the clamping circuit 450 is configured to operably clamp the voltage Vst of the storage capacitor Cs, so that the voltage Vst of the storage capacitor Cs is not higher than a second clamp voltage, wherein the first clamp voltage is lower than the second clamp voltage. That is, in the aforementioned embodiment, the clamping circuit 440 and the clamping circuit 450 are configured to operably clamp the voltage Vst of the storage capacitor Cs between the first clamp voltage and the second clamp voltage. Note that, in one embodiment, the voltage of the aforementioned internal power supply VII is higher than the second clamp voltage. A difference of the voltage of the aforementioned internal power supply VII minus the second clamp voltage is greater than a minimum operation voltage required by the discharging amplifier 70. On the other hand, in one embodiment, the first clamp voltage is greater than a minimum operation voltage required by each of the charging amplifiers 81 to 8n.

In one embodiment, each of the aforementioned discharging amplifier 70 and the aforementioned charging amplifiers 81 to 8n can be implemented as an operational amplifier having the aforementioned positive power supply end and negative power supply end. In one embodiment, sub-circuits of different stages in the operational amplifier (e.g., differential stage, gain stage, power amplification stage and so on) are coupled between the positive power supply end and the negative power supply end of the operational amplifier. The hardware and operation mechanism of the operational amplifier are well known to those skilled in this art, and can be modified according to application requirements under the teachings of the present invention, so the details thereof are not redundantly explained here.

Figure 4:
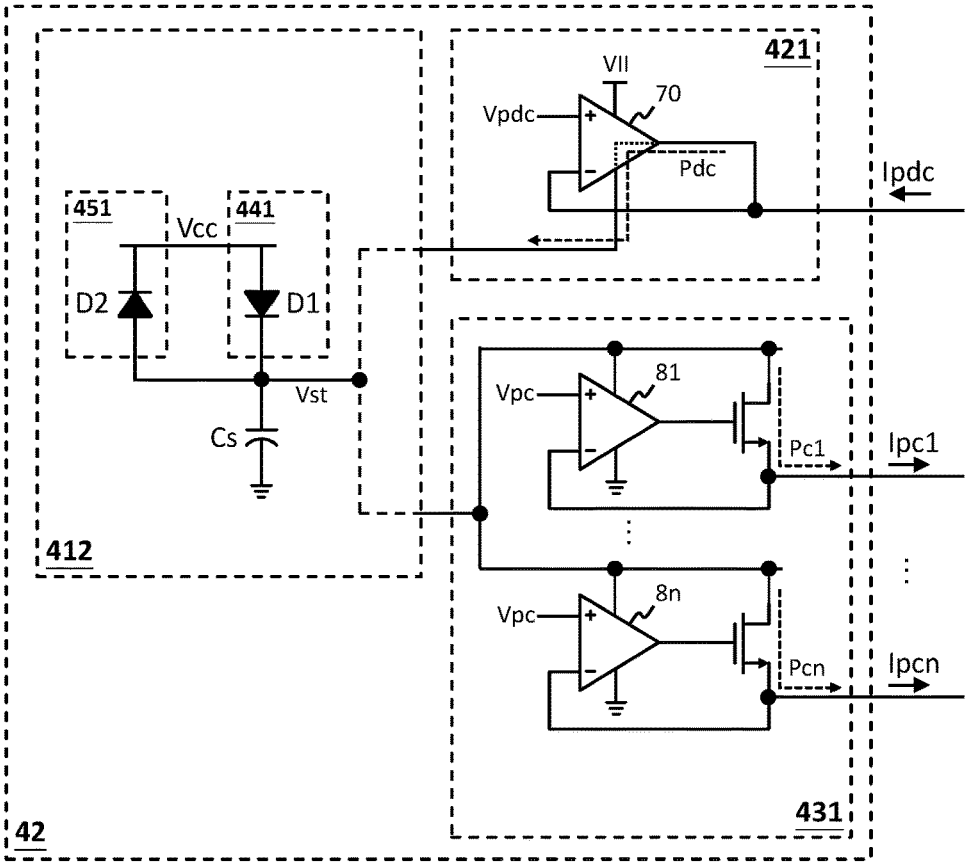
FIG. 4 shows a schematic diagram of a pre-power supply circuit in an LED driver circuit according to a specific embodiment of the present invention.

Please refer to FIG. 4, which shows a schematic diagram of a pre-power supply circuit in an LED driver circuit according to a specific embodiment of the present invention. The pre-power supply circuit 42 of this embodiment shown in FIG. 4 is similar to the pre-power supply circuit 41 of the embodiment shown in FIG. 3. In one embodiment, the power saving control circuit 412 in FIG. 4 includes: a clamping circuit 441 and a clamping circuit 451. In one embodiment, the clamping circuit 441 includes: a diode D1, which is forwardly coupled between a reference voltage Vcc and a storage capacitor Cs. In one embodiment, the clamping circuit 441 is configured to operably clamp the voltage Vst of the storage capacitor Cs, so that the voltage Vst of the storage capacitor Cs is not lower than a first clamp voltage. In this embodiment, the first clamp voltage is a difference between the reference voltage Vcc and the forward conduction voltage of the diode D1. In one embodiment, the clamping circuit 451 includes: a diode D2, which is forwardly coupled between the storage capacitor Cs and the reference voltage Vcc. In one embodiment, the clamping circuit 451 is configured to operably clamp the voltage Vst of the storage capacitor Cs, so that the voltage Vst of the storage capacitor Cs is not higher than a second clamp voltage. In this embodiment, the second clamp voltage is a sum of the reference voltage Vcc plus the forward conduction voltage of the diode D2. That is, in the aforementioned embodiment, the clamping circuit 441 and the clamping circuit 451 are configured to operably clamp the voltage Vst of the storage capacitor Cs between the first clamp voltage and the second clamp voltage.

Figure 5:
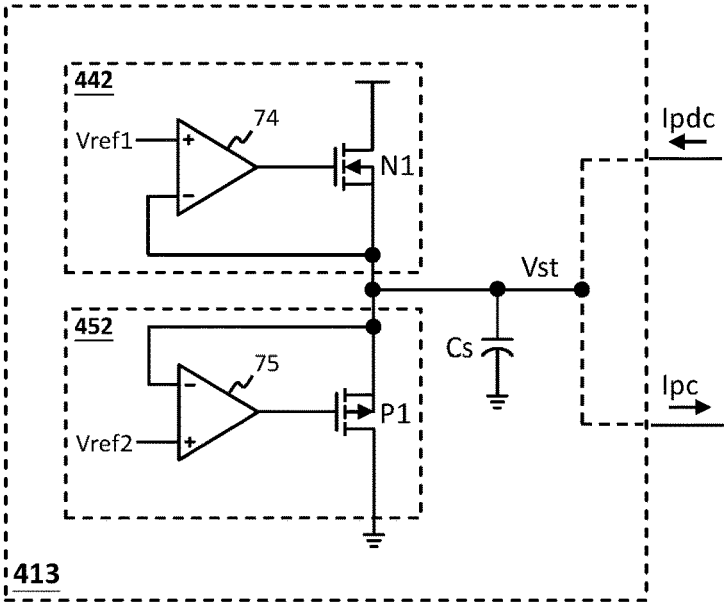
FIG. 5 shows a schematic diagram of a power saving control circuit in an LED driver circuit according to a specific embodiment of the present invention.

Please refer to FIG. 5, which shows a schematic diagram of a power saving control circuit in an LED driver circuit according to a specific embodiment of the present invention. In one embodiment, the power saving control circuit 413 in FIG. 5 includes: a clamping circuit 442 and a clamping circuit 452. In one embodiment, the clamping circuit 442 includes: a transistor N1 and an amplifier 74. In this embodiment, the transistor N1 is an N-type metal oxide semiconductor (MOS) device. The transistor N1 has its source coupled to a storage capacitor Cs and has its gate coupled to an output end of the amplifier 74. The amplifier 74 is configured to operably control the transistor N1 according to a difference between the clamp voltage Vref1 and a voltage Vst of the storage capacitor Cs, so as to clamp the voltage Vst of the storage capacitor Cs, so that the voltage Vst of the storage capacitor Cs is not lower than the clamp voltage Vref1 (corresponding to the aforementioned first clamp voltage). In one embodiment, the clamping circuit 452 includes: a transistor P1 and an amplifier 75. In this embodiment, the transistor P1 is a P-type metal oxide semiconductor (MOS) device. The transistor P1 has its source coupled to a storage capacitor Cs and has its gate coupled to an output end of the amplifier 75. The amplifier 75 is configured to operably control the transistor P1 according to a difference between the clamp voltage Vref2 and the voltage Vst of the storage capacitor Cs, so as to clamp the voltage Vst of the storage capacitor Cs, so that the voltage Vst of the storage capacitor Cs is not higher than the clamp voltage Vref2 (corresponding to the aforementioned second clamp voltage).

Figure 6:
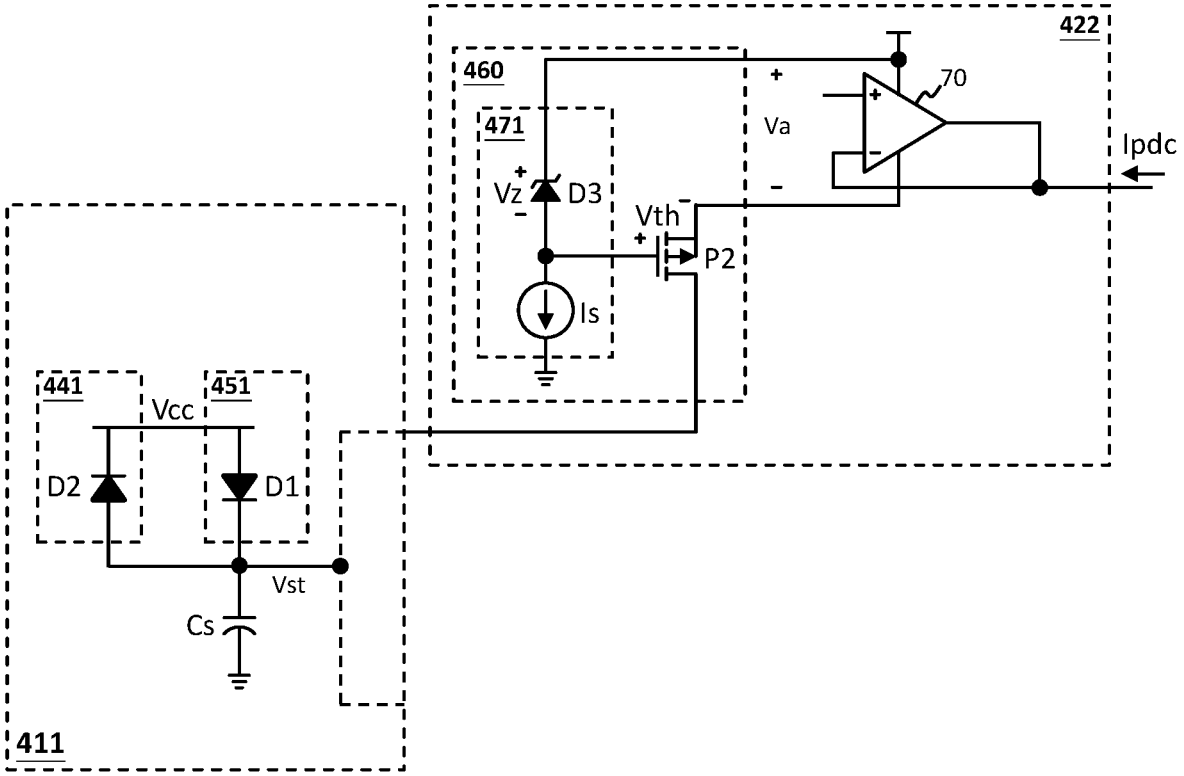
FIG. 6 shows a schematic diagram of a pre-discharging circuit in an LED driver circuit according to a specific embodiment of the present invention.

Please refer to FIG. 6, which shows a schematic diagram of a pre-discharging circuit in an LED driver circuit according to a specific embodiment of the present invention. In one embodiment, the pre-discharging circuit 422 of FIG. 6 further includes: a clamping circuit 460, which is configured to operably clamp an amplifier power supply voltage Va between the positive power supply end of the discharging amplifier 70 and the negative power supply end of the discharging amplifier 70, so that the amplifier power supply voltage Va is not higher than a third clamp voltage. More specifically, in one embodiment, the clamping circuit 460 includes: a transistor P2 and a voltage offset circuit 471. In one embodiment, the transistor P2 for example can be a P-type high voltage MOS device (HV PMOS), which is coupled between the storage capacitor Cs and the negative power supply end of the discharging amplifier 70. In one embodiment, as shown in FIG. 6, the voltage offset circuit 471 includes: a diode D3 and a current source Is, wherein the diode D3 can be, for example but not limited to, a Zener diode. In the embodiment shown in FIG. 6, the diode D3 is coupled between a control end (which is a gate of the transistor P2 in this embodiment) of the transistor P2 and the positive power supply end of the discharging amplifier 70. The current source Is is coupled between the control end of the transistor P2 and a ground potential. In this embodiment, the voltage offset circuit 471 is configured to operably control the transistor P2 to clamp the amplifier power supply voltage Va, so that the amplifier power supply voltage Va is not higher than the third clamp voltage, wherein the third clamp voltage is correlated with an offset voltage (which is an offset voltage Vz of the diode D3) of the voltage offset circuit 471 and a conduction threshold Vth of the transistor P2. More specifically, in this embodiment, the third clamp voltage is equal to Vz−|Vth|. It is noteworthy that, a maximum rating voltage of the transistor P2 is higher than a maximum rating voltage of the discharging amplifier 70, and/or the maximum rating voltage of the transistor P2 is higher than a maximum rating voltage of the power saving control circuit 411.

Figure 7:
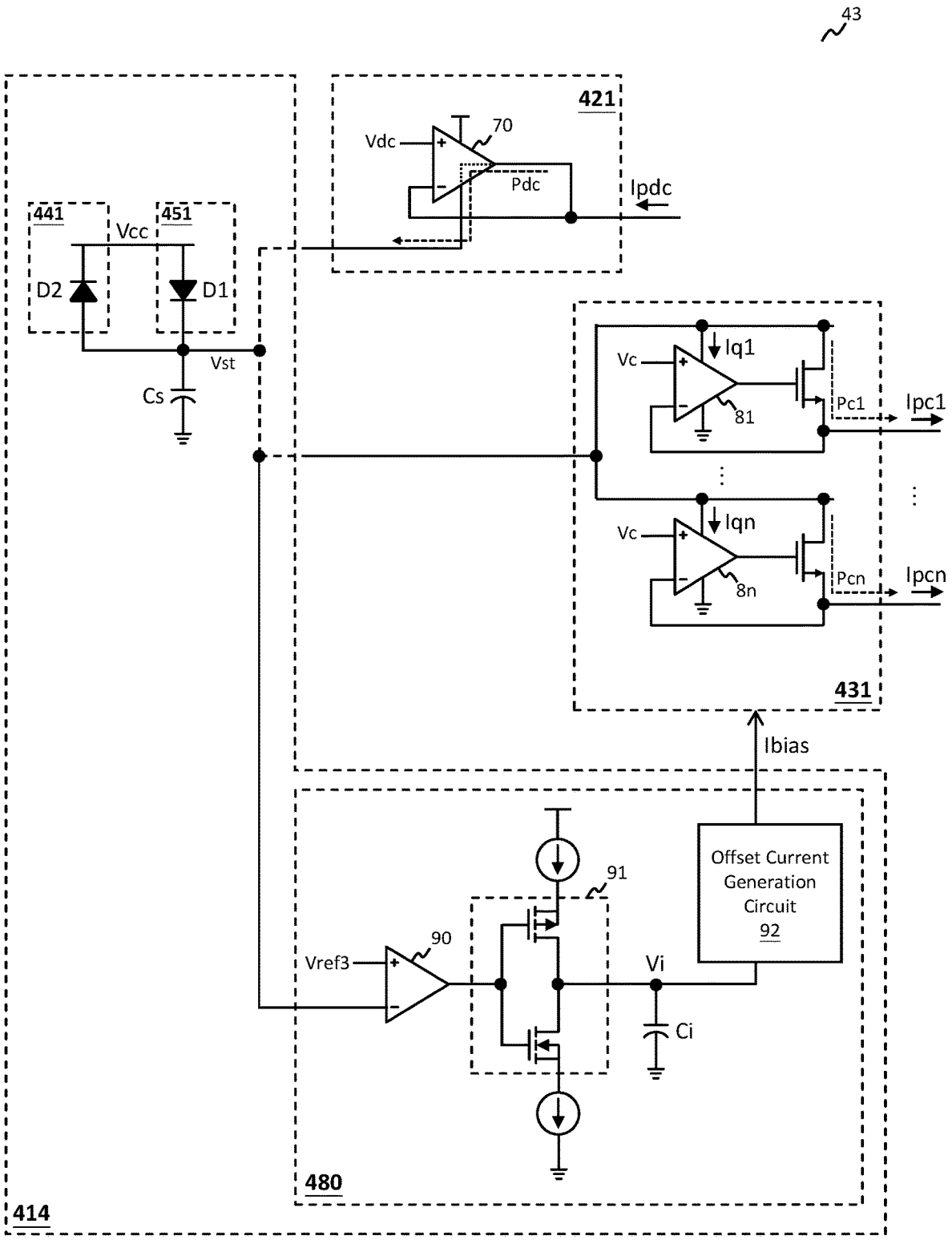
FIG. 7 shows a schematic diagram of a pre-power supply circuit in an LED driver circuit according to a specific embodiment of the present invention.

Please refer to FIG. 7, which shows a schematic diagram of a pre-power supply circuit in an LED driver circuit according to a specific embodiment of the present invention. The pre-power supply circuit 43 of this embodiment shown in FIG. 7 is similar to the pre-power supply circuit 42 of the embodiment shown in FIG. 4. In one embodiment, the power saving control circuit 414 of the pre-power supply circuit 43 in FIG. 7 further includes: a current balance circuit 480. In one embodiment, the current balance circuit 480 is configured to operably control a bias current Ibias required by the pre-charging circuit 431 according to a difference between the voltage Vst of the storage capacitor Cs and the reference voltage Vref3, so as to adjust a quiescent state current consumption (e.g., Iq1 or Iqn) of the pre-charging circuit 431, so that in a steady state, the charges pre-discharged from the m scan-lines and the charges pre-charged to the n data-lines are controlled to be balanced to each other. In one embodiment, the bias current Ibias serves to provide a bias current required by the operation of the charging amplifiers 81 to 8n. That is, the quiescent state current consumption (e.g., Iq1 or Iqn) of the pre-charging circuit 431 is under control by the bias current Ibias.

More specifically, in one embodiment, the current balance circuit 480 includes: a comparison circuit 92, an integration circuit 91 and a bias current generation circuit 92. In one embodiment, the comparison circuit 90 is configured to operably compare the voltage Vst of the storage capacitor Cs with the reference voltage Vref3, to generate a comparison result. The integration circuit 91 is configured to operably control a pull-up current source and a pull-down current source according to the comparison result, to generate an integration voltage Vi at an integration capacitor Ci. For example, when the reference voltage Vref3 is greater than the voltage Vst of the storage capacitor Cs, the integration circuit 91 controls the pull-down current source, to discharge the integration capacitor Ci, thus decreasing the integration voltage Vi. On the other hand, when the reference voltage Vref3 is smaller than the voltage Vst of the storage capacitor Cs, the integration circuit 91 controls the pull-up current source, to charge the integration capacitor Ci, thus increasing the integration voltage Vi. In one embodiment, the bias current generation circuit 92 is configured to operably generate the bias current Ibias according to the integration voltage Vi, wherein the bias current Ibias is correlated with the integration voltage Vi (e.g., the bias current Ibias is positively correlated with the integration voltage Vi). In one embodiment, preferably, in a steady sate, the level of the voltage Vst of the storage capacitor Cs is equal to the level of the reference voltage Vref3.

Please refer to FIG. 4 and FIG. 7. In one embodiment, the first clamp voltage is smaller than the reference voltage Vref3 and the reference voltage Vref3 is smaller than the second clamp voltage. Please refer to FIG. 5 and FIG. 7. In one embodiment, the clamp voltage Vref1 is smaller than the reference voltage Vref3 and the reference voltage Vref3 is smaller than the clamp voltage Vref2.

The present invention has been described in considerable detail with reference to certain preferred embodiments thereof. It should be understood that the description is for illustrative purpose, not for limiting the broadest scope of the present invention. An embodiment or a claim of the present invention does not need to achieve all the objectives or advantages of the present invention. The title and abstract are provided for assisting searches but not for limiting the scope of the present invention. Those skilled in this art can readily conceive variations and modifications within the spirit of the present invention. For example, to perform an action "according to" a certain signal as described in the context of the present invention is not limited to performing an action strictly according to the signal itself, but can be performing an action according to a converted form or a scaled-up or down form of the signal, i.e., the signal can be processed by a voltage-to-current conversion, a current-to-voltage conversion, and/or a ratio conversion, etc. before an action is performed. It is not limited for each of the embodiments described hereinbefore to be used alone; under the spirit of the present invention, two or more of the embodiments described hereinbefore can be used in combination. For example, two or more of the embodiments can be used together, or, a part of one embodiment can be used to replace a corresponding part of another embodiment. In view of the foregoing, the spirit of the present invention should cover all such and other modifications and variations, which should be interpreted to fall within the scope of the following claims and their equivalents.

What is claimed is:

1. A light emitting diode (LED) driver circuit, which is configured to operably drive a plurality of LEDs, wherein the plurality of LEDs are respectively coupled to corresponding m scan-lines and corresponding n data-lines, wherein m and n are both integers greater than or equal to one, wherein during a driving stage, each of the LEDs is controlled to emit light according to electrical characteristics on the corresponding scan-line and on the corresponding data-line where the LED is coupled to; the LED driver circuit comprising:

a power saving control circuit, which includes a storage capacitor;

a pre-discharging circuit, which is configured to operably pre-discharge charges on the m scan-lines to the storage capacitor during a pre-discharging stage; and a pre-charging circuit, which is configured to operably pre-charge the n data-lines by the charges stored in the storage capacitor during a pre-charging stage.

2. The LED driver circuit of claim 1, further comprising:

a scan-line control circuit, which is configured to operably and sequentially provide power supply to the m scan-lines during the driving stage; and a data-line control circuit, which is configured to operably provide respective driving currents to the n data-lines according to corresponding data during the driving stage, so as to control the corresponding LEDs to emit corresponding brightness.

3. The LED driver circuit of claim 1, wherein:

the pre-discharging circuit includes: a discharging amplifier, which is configured to operably pre-discharge voltages on the m scan-lines and regulate the voltages on the m scan-lines to a pre-discharging voltage during the pre-discharging stage;

the pre-charging circuit includes: a charging amplifier, which is configured to operably pre-charge voltages on the n data-lines and regulate the voltages on the n data-lines to a pre-charging voltage during the pre-charging stage;

wherein a negative power supply end of the discharging amplifier is coupled to the storage capacitor, so that a voltage of the storage capacitor functions as a negative power supply of the discharging amplifier, to thereby pre-discharge the charges on the m scan-lines to the storage capacitor;

wherein a positive power supply end of the charging amplifier is coupled to the storage capacitor, so that the voltage of the storage capacitor functions as a positive power supply of the charging amplifier, to thereby pre-charge the n data-lines by the charges stored in the storage capacitor.

4. The LED driver circuit of claim 3, wherein the pre-discharging circuit further includes:

a third clamping circuit, which is configured to operably clamp an amplifier power supply voltage between a positive power supply end of the discharging amplifier and the negative power supply end of the discharging amplifier, so that the amplifier power supply voltage is not higher than a third clamp voltage.

5. The LED driver circuit of claim 4, wherein the third clamping circuit includes:

a third transistor, which is coupled between the storage capacitor and the negative power supply end of the discharging amplifier; and a voltage offset circuit, which is coupled between a control end of the third transistor and the positive power supply end of the discharging amplifier, wherein the voltage offset circuit is configured to operably control the third transistor to clamp the amplifier power supply voltage, so that the amplifier power supply voltage is not higher than the third clamp voltage;

wherein the third clamp voltage is correlated with an offset voltage of the voltage offset circuit and a conduction threshold of the third transistor.

6. The LED driver circuit of claim 5, wherein a maximum rating voltage of the third transistor is higher than a maximum rating voltage of the discharging amplifier, and/or the maximum rating voltage of the third transistor is higher than a maximum rating voltage of the power saving control circuit.

7. The LED driver circuit of claim 1, wherein the power saving control circuit further includes:

a first clamping circuit and a second clamping circuit, wherein the first clamping circuit is configured to operably clamp the voltage of the storage capacitor, so that the voltage of the storage capacitor is not lower than a first clamp voltage, and wherein the second clamping circuit is configured to operably clamp the voltage of the storage capacitor, so that the voltage of the storage capacitor is not higher than a second clamp voltage, wherein the first clamp voltage is lower than the second clamp voltage.

8. The LED driver circuit of claim 7, wherein the first clamping circuit includes:

a first diode, which is forwardly coupled between a first reference voltage and the storage capacitor, wherein the first clamp voltage is a difference between the first reference voltage and a forward conduction voltage of the first diode;

wherein the second clamping circuit includes:

a second diode, which is forwardly coupled between the storage capacitor and the first reference voltage, wherein the second clamp voltage is a sum of the first reference voltage plus a forward conduction voltage of the second diode.

9. The LED driver circuit of claim 7, wherein the first clamping circuit includes:

a first transistor, which is coupled to the storage capacitor; and a first amplifier, which is configured to operably control the first transistor according to a difference between the first clamp voltage and the voltage of the storage capacitor, so as to clamp the voltage of the storage capacitor, so that the voltage of the storage capacitor is not lower than the first clamp voltage;

wherein the second clamping circuit includes:

a second transistor, which is coupled to the storage capacitor; and a second amplifier, which is configured to operably control the second transistor according to a difference between the second clamp voltage and the voltage of the storage capacitor, so as to clamp the voltage of the storage capacitor, so that the voltage of the storage capacitor is not higher than the second clamp voltage.

10. The LED driver circuit of claim 1, wherein the power saving control circuit further includes:

a current balance circuit, which is configured to operably control a bias current required by the pre-charging circuit according to a difference between the voltage of the storage capacitor and a second reference voltage, so as to adjust a quiescent state current consumption of the pre-charging circuit, so that in a steady state, the charges pre-discharged from the m scan-lines and the charges pre-charged to the n data-lines are controlled to be balanced to each other.

11. The LED driver circuit of claim 10, wherein the current balance circuit includes:

a comparison circuit, which is configured to operably compare the voltage of the storage capacitor with the second reference voltage, to generate a comparison result;

an integration circuit, which is configured to operably control a pull-up current source and a pull-down current source according to the comparison result, to generate an integration voltage at an integration capacitor; and a bias current generation circuit, which is configured to operably generate the bias current according to the integration voltage, wherein the bias current is correlated with the integration voltage.

12. A control method configured to operably control a light emitting diode (LED) driver circuit, wherein the LED driver circuit includes a plurality of LEDs, wherein the plurality of LEDs are respectively coupled to corresponding m scan-lines and corresponding n data-lines, wherein m and n are both integers greater than or equal to one; the control method comprising:

during a driving stage, controlling each of the LEDs to emit light according to electrical characteristics on the corresponding scan-line and on the corresponding data-line where the LED is coupled to;

during a pre-discharging stage, pre-discharging charges on the m scan-lines to a storage capacitor;

during a pre-charging stage, pre-charging the n data-lines by the charges stored in the storage capacitor.

13. The control method of claim 12, further comprising:

during the driving stage, sequentially providing power supply to the m scan-lines; and during the driving stage, providing driving currents to the n data-lines according to corresponding data, so as to control the corresponding LEDs to emit corresponding brightness.

14. The control method of claim 12, further comprising:

clamping a voltage of the storage capacitor, so that the voltage of the storage capacitor is not lower than a first clamp voltage;

clamping the voltage of the storage capacitor, so that the voltage of the storage capacitor is not higher than a second clamp voltage;

wherein the first clamp voltage is lower than the second clamp voltage.

15. The control method of claim 12, further comprising:

controlling a bias current required by a pre-charging circuit according to a difference between the voltage of the storage capacitor and a reference voltage, so as to adjust a quiescent state current consumption of the pre-charging circuit, so that in a steady state, the charges pre-discharged from the m scan-lines and the charges pre-charged to the n data-lines are controlled to be balanced to each other;

wherein the pre-charging circuit is configured to operably pre-charge the n data-lines by the charges stored in the storage capacitor during the pre-charging stage.

16. The control method of claim 15, the step for controlling the bias current includes:

comparing the voltage of the storage capacitor with the reference voltage, to generate a comparison result;

controlling a pull-up current source and a pull-down current source according to the comparison result, to generate an integration voltage at an integration capacitor; and generating the bias current according to the integration voltage, wherein the bias current is correlated with the integration voltage.

* * * * *